United States Patent [19]

Dunlap

[11] Patent Number: 4,632,441

[45] Date of Patent: Dec. 30, 1986

[54] SCOOP FOR SOLIDS

[75] Inventor: Raymond R. Dunlap, Uxbridge, Mass.

[73] Assignee: Zymark Corporation, Hopkinton, Mass.

[21] Appl. No.: 677,392

[22] Filed: Dec. 3, 1984

[51] Int. Cl.[4] ..... B66F 9/00

[52] U.S. Cl. ..... 294/1.1; 73/426; 294/50; 294/53.5; 294/55; 901/30

[58] Field of Search ..... 294/9, 10, 1.1, 49–50.6, 294/50.8, 50.9, 53.5, 55, 68.1, 68.2, 68.26; D7/100, 104; 30/128, 324; 37/55, 118 R, 119, 137, 138; 73/426, 864.31, 864.32; 141/108–111, 390, 391; 222/356, 358; 414/685, 722, 723, 725; 901/30

[56] References Cited

U.S. PATENT DOCUMENTS

| | | | |
|---|---|---|---|
| 668,308 | 2/1901 | Finch et al. | 294/53.5 |
| 668,982 | 2/1901 | Covel | 294/55 |
| 1,271,287 | 7/1918 | Daly | 294/55 |
| 3,001,404 | 9/1961 | McDonnell et al. | 73/426 |

FOREIGN PATENT DOCUMENTS

| | | | |
|---|---|---|---|
| 2974 | 4/1900 | Denmark | 294/53.5 |
| 40188 | 5/1929 | Denmark | 294/53.5 |
| 42165 | 5/1930 | Denmark | 294/53.5 |
| 875793 | 7/1949 | Fed. Rep. of Germany | 294/53.5 |
| 24804 | 7/1951 | Finland | 294/53.5 |
| 1296608 | 5/1962 | France | 294/50 |

*Primary Examiner*—Johnny D. Cherry
*Attorney, Agent, or Firm*—Andrew F. Kehoe

[57] ABSTRACT

A scoop for picking up particulate, granular, or penetrable solids. The scoop itself is a rugged one-piece construction that has a bucket member which is pushed into solids to be scooped in a normal "open" position. The scoop is constructed in the shape of a wedge to facilitate entry into the mass of solids and allows the force exerted on the scoop by the solids to assist in closing of the scoop.

14 Claims, 10 Drawing Figures

SCOOP FOR SOLIDS

BACKGROUND OF THE INVENTION

This invention relates to a simple apparatus for scooping up samples of solids, particularly fine powder, granular solids, and paste-like solids such as butter and the like. The invention relates most particularly to inexpensive and disposable apparatus for use in relatively small-scale laboratory operations.

A large number of means have been devised for scooping solids over the years. Much of this art is found in classes identified in the Manual of Classification of the U.S. Patent Office such as Class 73-863 (various) 73-864 (various) and Class 141-108. Also, substantial work relating to the transport of laboratory samples, usually liquid samples, is described in Class 422-50. None of this art relates to inexpensive, nor even disposable, means for moving a wide variety of small solid samples from station to station in a laboratory environment or other environments where samples must be taken periodically as part of a quality control procedure.

SUMMARY OF THE INVENTION

It is a principal object of the invention to provide an improved scoop for use with solids.

Another object of the invention is to provide an inexpensive, one-piece scoope that is both readily cleanable and economically disposable after a single use.

A further object of the invention is to provide a scoope that can be readily utilized by remote control, e.g. by a robot system.

Still another object of the invention includes the development of novel processes manifested by use of the scooping system described below.

The above objects have been substantially achieved by utilizing a scoop apparatus comprising a scoop member that is shaped to comprise a scoop-closing wedge when the scoop is pushed into a mass of solids to be scooped. The scoop is pivotally mounted on its operating shaft so that it is retained in the closed, i.e. solids-carrying position, until returned to the first, open, position, i.e. the position in which it serves as a solids penetrating means to facilitate its entry into the mass of solids.

In one simple, yet effective, embodiment of the invention, the scoop apparatus is a one-piece, molded, thermoplastic article on which the scoop body is hinged, e.g. by polypropylene hinges on the like, so that the strength of the hinge is sufficient to retain a solids-bearing scoop in a solids-carrying position. However, as will be described below, it is also possible, and sometimes convenient, to provide for use of mechanical retention means to hold the scoop in its open or in its solids-carrying position.

In one advantageous practice of the invention, the scoop is utilized with scoop-cleaning and/or repositioning means. Such a device can be operated by a robot-hand of the syringe-operating type. (This type of hand is known in the art and is utilized on the automated laboratory robot system sold by Zymark Corporation of Hopkinton, Mass.) In one such embodiment, a hollow lifting plug is inserted into the operating rod of the scoop apparatus and the cleaning means is slideably pushed downwardly through the plug to clean and to open, the scoop.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for the purposes of illustration in order that others skilled in the art will more fully understand the invention and the principles thereof and will be able to modify it and embody it in a variety of forms, each as may be best suited to the condition of a particular case.

IN THE DRAWINGS

Figure 1:
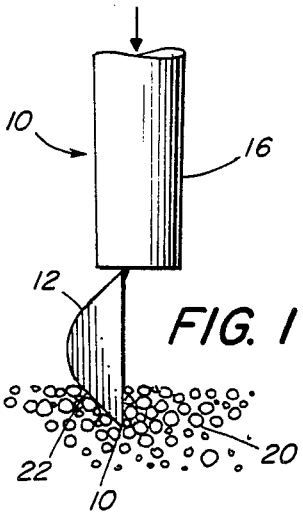
FIGS. 1 and 2 are views of the scoop of the invention in open position taken at right angles to each other and as the scoop is about to enter a mass of solid particles.
Figure 2:
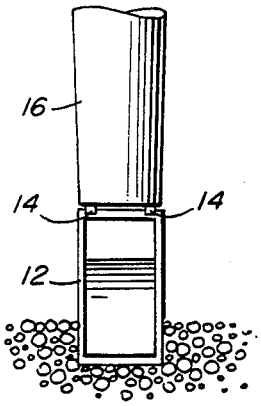

Referring to FIGS. 1 and 2, it is seen that a scooping apparatus 10 is formed of a single molded piece of polypropylene thermoplastic polymer. The apparatus 10 comprises a scoop 12 pivotally mounted by two small hinges 14 onto a hollow operating rod, or handle, 16. Scoop 12 is shaped to form a penetration wedge 18 for aid in insertion into a bed of solid material 20. The wedge formed by the bottom of said scoop and the leading edge of said scoop may have a number of shapes, but the illustrated shape of about 45 angular degrees is useful with a wide variety of flowable and non-flowable, yet scoopable, solids.

Figure 3:
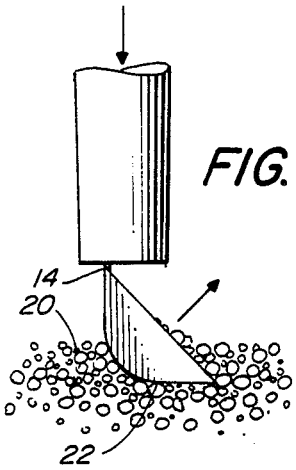
FIG. 3 illustrates the closing action of the scoop as it is pushed into the particles.
Figure 4:
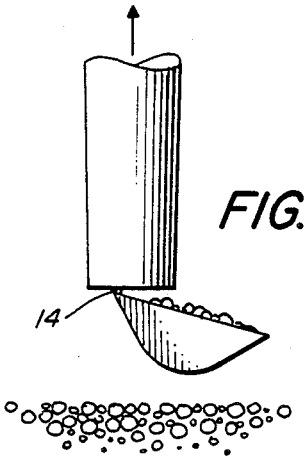
FIG. 4 illustrates the scoop of FIGS. 1–3 in a typical closed position.

As scoop 16 is pushed further into the solids (See FIG. 3), the solids push upwardly against bearing surface 22. This causes a force vector which swings scoop 12 towards a closed, i.e. a solids-retaining position as shown in FIG. 4.

Figure 5:
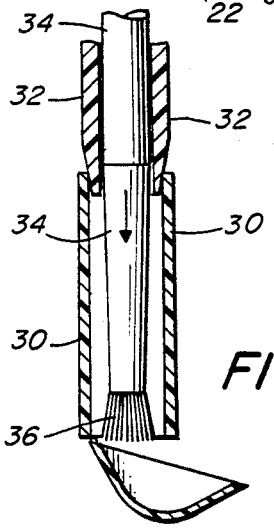
FIG. 5 illustrates a scoop assembly complete with a carrying plug and cleaning means.

FIG. 5 illustrates an advantageous scooping apparatus according to the invention. The operating rod is a hollow tube 30. It is integral with the scoop. The walls of tube 30 are snugly gripped by an internally-inserted gripping means 32 which is conveniently used as a gripping surface to move the scoop apparatus.

Slideably inserted through tube 30 is a scoop-positioning means 34 comprising a scoop-cleaning means such as brush 36 at one end thereof. This brush is advantageously used to clean out the solids should such cleaning be required or to reposition the scoop, if it is to be reused, for another pass into a bed of solids. In operation, this apparatus would conveniently be operated by a syphon-operating robot hand, the closure means 32 or tube 30 being held like a syringe barrel, and the scoop-cleaning means being pushed like the piston of a syringe.

Figure 7:
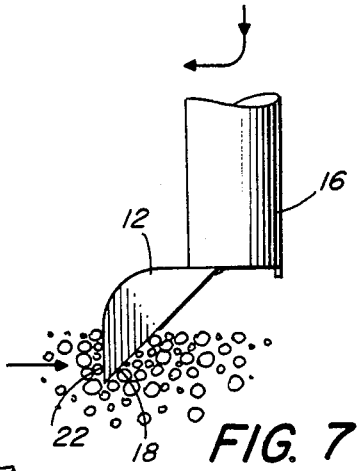
FIG. 7 illustrates another way in which a scoop of the invention can be used.

As is seen in FIG. 7, it is possible to utilize the scooping apparatus of the invention in different modes. For example, if bearing surface 22 were inserted as shown in FIG. 7, it would not provide the helpful lateral vector to help close the scoop during insertion into the solids. Nevertheless, the scoop would be closed and rotated into a closed position by the sequence of forces brought against the scoop as it is moved to the left, through a bed of particulate solids, during or after insertion into the solids.

Figure 8:
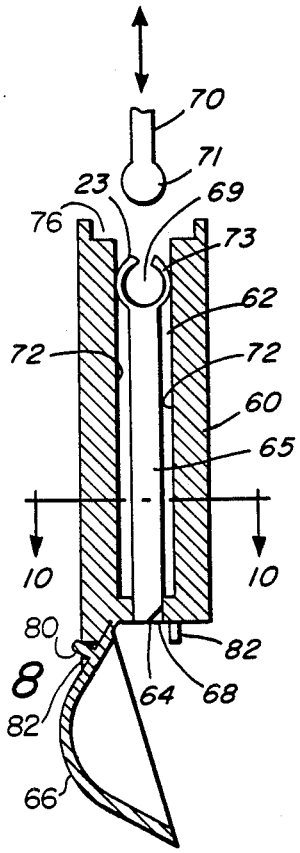
FIG. 8 illustrates, partly in section, another scoop assembly constructed according to the apparatus of the invention and comprising a different scoop-clearing means and attachment therefor.
Figure 9:
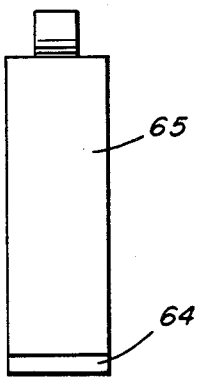
FIG. 9 is a side view of a plow used in the apparatus of FIG. 8.
Figure 10:
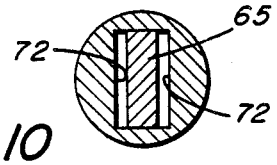
FIG. 10 is a section through FIG. 8.

Referring to FIG. 8, it is seen that the scoop-bearing cylinder 60 has an interior slot 62 which provides sliding passage for a scoop-cleaning means 65 carrying a plow 64. Plow 64 moves into and out of scoop 66 through an annular aperture slot 68. Plow 64 forms means to push material out of scoop 66 and to push scoop 66 into its open position by pushing plow 64 through bottom slot 68, thereby pushing the scoop into an open position.

The top of plow 64 is operably fastened to an external push-pull operating means 70 through a resilient, typically polypropylene, socket 69 molded into cleaning means 65. Typically resilient socket 69 receives a ball 71 which, only then, is pushed downwardly so that two prongs 73 of the socket are forced to close about the ball 71 by bearing walls 72 of slot 62. Arcuate prongs 73 of the socket hold the balls tightly until it is pulled upwardly into release zone 76 where the ball is readily removed from the socket since prongs 73 are no longer closed by contact with bearing walls 72.

Scoop 66 is held in its open position by a mechanical snap means as at 80. It is held in its closed (solids-retaining) positions by two resilient plastic projections 82 which snap into, or fit snugly against, small identations in the inner walls of scoop 66.

Plow 64 is so positioned that it effectively opens the scoop, causes it to empty, efectively scrapes it clean, and pushed it into a snapped-open position before it is retracted.

Figure 6:
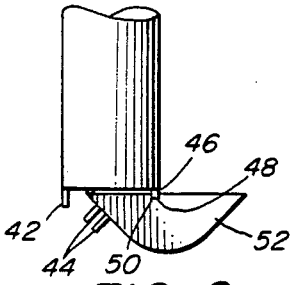
FIG. 6 illustrates a scoop assembly with mechanical retention means for holding the scoop in open and closed positions.

FIG. 6 illustrates a snap-like closure formed of male tab 42 and and female receptacle 44 and which forms means to hold the scoop in open position. Another such fastening means 46 is formed of a male tab 48 snapping into an indentation 50 in scoop 52.

It is also to be understood that the following claims are intended to cover all of the generic and specific features of the invention herein described in all statement of the scope of the invention which might be said to fall therebetween.

What is claimed is:

1. A molded one-piece scooping apparatus comprising a scoop, hinge means and an operating rod; said scoop being pivotally mounted by said hinge means on said operating rod;

wherein said scoop is pivotally mounted on said hinge means between a first, open position, and a second, closed position;

wherein a bottom and leading edge of said scoop, in said open position, forms a wedge means for penetrating particulate solids to be scooped;

and wherein at least one surface of said scoop forms a bearing surface for pivoting said scoop into said closed position as said scoop is moved through said solids to be scooped and where said hinge means forms means to retain solids in said scoop when said scoop is in said closed position.

2. Apparatus as defined in claim 1 wherein said operating rod is hollow and forms means to receive a lifting plug forming gripping means to snugly and releasably grip said apparatus.

3. Apparatus as defined in claim 2 wherein said hollow operating rod forms access means for a scoop repositioning rod depending through said operating rod and forming means to reposition said scoop in said first position.

4. Apparatus as defined in claim 3 wherein said hinge means is the sole structure forming means to retain said scoop in said closed position.

5. Apparatus as defined in claim 2 wherein said scooping apparatus comprises a mechanical retaining means for holding said scoop in said second position.

6. Apparatus as defined in claim 1 wherein said scooping apparatus comprises a mechanical retaining means for precisely positioning said scoop in a predetermined said second position.

7. Apparatus as defined in claim 1 wherein said hinge means is the sole structure forming means to retain said scoop and any solids retained therein in said closed position.

8. A one-piece scoop assembly comprising (1) a scoop, hinge means and a hollow operating rod; said scoop pivotally mounted by said hinge means on said operating rod;

wherein said scoop is pivotally mounted on said hinge means between a first, open position, and a second closed, position;

wherein a bottom and leading edge of said scoop, in said open position, forms a wedge means for penetrating particulate solids to be scooped;

wherein at least one surface of said scoop forms a bearing surface for pivoting said scoop into said closed position as said scoop is moved through said solids to be scooped;

wherein said hinge means forms means to retain solids in said scoop when said scoop is in said closed position;

and (2) a lifting plug received within said operating rod and forming gripping means to snugly and releasably grip said operating rod; and wherein said lifting plug comprises a path therein allowing a scoop opening and cleaning means to contact and clean said scoop.

9. An assembly as defined in claim 8 wherein said hinge means is the sole structure forming means to retain said scoop in said closed position.

10. An assembly as defined in claim 8 wherein said scoop opening and cleaning means has (A) a resilient socket forming prong means (a) to receive an external operating means in an open-prong position and (b) to lock said operating means to said scoop opening and cleaning means by closing said resilient socket into a closed-prong position and (B) bearing walls forming means to close said resilient socket into locked position as it is moved into said closed-prong position.

11. An assembly as defined in claim 10 comprising mechanical retaining means for holding said scoop in each of said second position and said first position.

12. An assembly as in claim 10 wherein said scoop-opening and cleaning means is of a plow-blade configuration.

13. An assembly as in claim 8 wherein said scoop-opening and cleaning means is of a plow-blade configuration.

14. A process for scooping up solids comprising the steps of:

depressing a monolithic scoop having an operating rod and a wedge-shaped bottom toward and into said solids while the scoop is in a substantially vertical open position;

pivoting the scoop towards a solids-retention position by forcing said wedge-shaped bottom into said solids;

removing the scoop from the solids once it reaches said solids-retention position; and, maintaining said solids-retention position solely by the use of an integrally-molded plastic hinge between said scoop and an operating rod therefor.

* * * * *